US007921658B2

(12) United States Patent
Wetekamp

(10) Patent No.: US 7,921,658 B2
(45) Date of Patent: Apr. 12, 2011

(54) CONTROL FOR A REFRIGERATOR DOOR DISPENSER LIGHT

(75) Inventor: Robert L. Wetekamp, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 75 days.

(21) Appl. No.: 12/511,280

(22) Filed: Jul. 29, 2009

(65) Prior Publication Data

US 2009/0284157 A1 Nov. 19, 2009

Related U.S. Application Data

(62) Division of application No. 11/327,412, filed on Jan. 9, 2006, now Pat. No. 7,568,358.

(51) Int. Cl.
*F25C 1/00* (2006.01)

(52) U.S. Cl. ..... 62/66; 66/264; 66/389

(58) Field of Classification Search ..... 62/66, 125, 62/126, 127, 129, 135, 264; 222/52, 146.6; 362/94, 93, 92; 315/154, 159
See application file for complete search history.

(56) References Cited

U.S. PATENT DOCUMENTS 4,868,672 A * 9/1989 Hiroki et al. ..... 358/494
5,126,078 A * 6/1992 Steiner et al. ..... 261/26
5,253,782 A * 10/1993 Gates et al. ..... 221/15
5,823,390 A * 10/1998 Muderlak et al. ..... 222/38
6,139,017 A * 10/2000 Kawamura ..... 273/445
6,394,310 B1 * 5/2002 Muderlak et al. ..... 222/1
6,543,335 B1 * 4/2003 Lassota ..... 99/283
6,636,772 B1 * 10/2003 Renau ..... 700/83
6,681,585 B1 * 1/2004 Stagg et al. ..... 62/177
6,705,356 B2 * 3/2004 Barton et al. ..... 141/2
7,089,763 B2 * 8/2006 Forsberg et al. ..... 62/635
7,201,005 B2 * 4/2007 Voglewede et al. ..... 62/126
7,543,453 B2 * 6/2009 Boarman et al. ..... 62/98
2002/0016198 A1 * 2/2002 Faith ..... 463/16
2003/0155031 A1 * 8/2003 Barton et al. ..... 141/2
2005/0268624 A1 * 12/2005 Voglewede et al. ..... 62/126

* cited by examiner

*Primary Examiner* — Mohammad M Ali
(74) *Attorney, Agent, or Firm* — John W. Morrison; Diederiks & Whitelaw PLC

(57) ABSTRACT

A door mounted dispenser for a refrigerator includes rear and opposing side walls that collectively define a cavity, a release mechanism for dispensing ice and/or water and a light for illuminating the cavity. The cavity light can be operated in one of three distinct modes, i.e., in a first mode wherein the cavity light is continuously illuminated, in a second mode wherein the cavity light is illuminated only through activation of the release mechanism, and in a third mode wherein the cavity light is illuminated based upon a sensed level of ambient light present at or near the refrigerator. In the third mode, the cavity light is illuminated at a first level based upon ambient light and a second, higher level when the release mechanism is operated. The level of ambient light necessary to activate the cavity light can be set by a consumer through control panel inputs.

17 Claims, 2 Drawing Sheets

CONTROL FOR A REFRIGERATOR DOOR DISPENSER LIGHT

CROSS REFERENCE TO RELATED APPLICATIONS

This application is a divisional of U.S. patent application Ser. No. 11/327,412, filed on Jan. 9, 2006, which application is hereby incorporated by reference.

BACKGROUND OF THE INVENTION

1. Field of the Invention

The present invention pertains to the art of refrigerators and, more particularly, to a control for operating a light associated with a refrigerator door dispenser.

2. Discussion of the Prior Art

Door mounted dispensers are widely known in the art of refrigerators. Typically, the dispenser is mounted in the freezer door and, when activated, dispenses ice and/or water depending upon a consumer's particular need. Dispensers are provided in various forms and with a variety of features depending on the particular refrigerator model. That is, dispensers can range from models that simply dispense ice cubes and/or water, to more complex models that dispense ice in various forms, as well as provide filtered water.

Most dispensers incorporate a light that is illuminated whenever the dispenser is activated. In some cases, the dispenser light can be employed as a night light. That is, the light is illuminated at a first level based upon ambient light conditions and, at a second, higher, level when the dispenser is activated. The higher level increases visibility in order to enable a consumer to readily release ice or water into, for example, a glass. However, one problem encountered with the night light is establishing an ambient light level at which the light will be illuminated at the first level. It has been found that, depending on the installation, the light is typically illuminated too early in the day. In some particularly low-light level installations, the light may be operated continuously, thereby providing a false impression that a problem may exist with the refrigerator. In either case, the overall service life of the light is reduced significantly.

Therefore, despite the existence of light controls for dispensers in the prior art, there still exists a need for a control for a refrigerator dispenser light. More specifically, there exists a need for a control that enables a consumer to selectively set an ambient light level at which the dispenser light is activated when operating in a night light mode.

SUMMARY OF THE INVENTION

The present invention is directed to a light control for a dispenser mounted on a refrigerator door. The refrigerator includes an outer shell within which is defined a fresh food compartment and a freezer compartment. The refrigerator further includes a door which is pivotally mounted relative to the outer shell for selectively closing at least one of the fresh food and freezer compartments. The door is provided with a dispenser that enables a consumer to retrieve ice and/or water without accessing the compartment, while the dispenser incorporates a light.

In accordance with a preferred embodiment of the invention, the dispenser includes rear and opposing side walls that collectively define a cavity, which is adapted to be illuminated by the light, and a release mechanism for dispensing ice and/or water. The light can be operated in one of three distinct modes. In a first mode, the light is continuously illuminated.

In a second mode, the light is illuminated only through activation of the release mechanism. In a third mode, the light is illuminated based upon a sensed level of ambient light present at or near the refrigerator. More specifically, in the third mode, the light is illuminated at a first level based upon ambient light, and a second, higher level when the release mechanism is operated. In the most preferred form of the invention, the level of ambient light required to activate the light in the third mode can be set by a consumer through control panel inputs.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENTS

Figure 1:
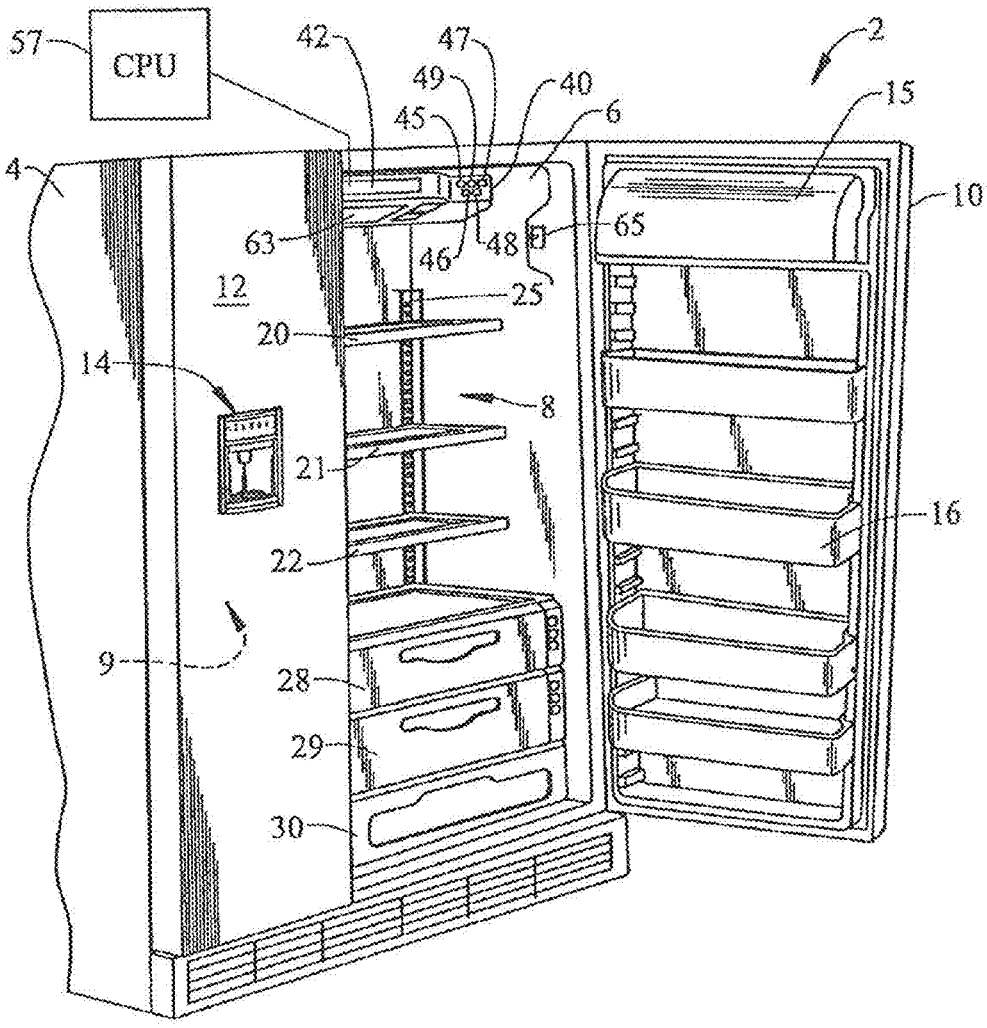
FIG. 1 is a partial, right perspective view of a refrigerator including a control for selectively activating a light associated with a door mounted dispenser constructed in accordance with the present invention.

With initial reference to FIG. 1, a refrigerator 2 includes an outer shell or cabinet 4 within which is positioned a liner 6 that defines a fresh food compartment 8. Another liner (not shown) is also positioned in cabinet 4 to define a freezer compartment 9. In a manner known in the art, fresh food compartment 8 can be accessed by the selective opening of a fresh food door 10. In a similar manner, a freezer door 12 can be opened to access freezer compartment 9. In the embodiment shown, freezer door 12 includes a dispenser 14 that enables a consumer to retrieve ice and/or fresh water without accessing fresh food compartment 8 or freezer compartment 9. For the sake of completeness, fresh food door 10 is shown to include a dairy compartment 15 and various vertically adjustable shelving units, one of which is indicated at 16.

In a manner also known in the art, fresh food compartment 8 is provided with a plurality of vertically height adjustable shelves 20-22 supported by a pair of shelf support rails, one of which is indicated at 25. At a lowermost portion of fresh food compartment 8 is illustrated various temperature or climate controlled bins 28 and 29, as well as a conventional storage compartment 30. At an upper region of fresh food compartment 8 is mounted a temperature control housing or user interface 40. In the embodiment shown, interface 40 includes a display zone 42 and a plurality of control elements 45-49. Control elements 45-48 are constituted by temperature control elements for adjusting a temperature of fresh food compartment 8 and freezer compartment 9, while control element 49 is constituted by an auxiliary control element for re-setting, for example, a door alarm. The particular details of user interface 40 are set forth in greater detail in commonly assigned U.S. patent application entitled "Refrigerator Control Including a Hidden Features Menu" filed on even date herewith. In any event, for the sake of completeness, interface 40 includes a controller or CPU 57 operatively connected to refrigeration components (not shown), as well as a light 63 which, in a manner known in the art, is controlled by a switch 65 operated by opening and closing door 10.

Figure 2:
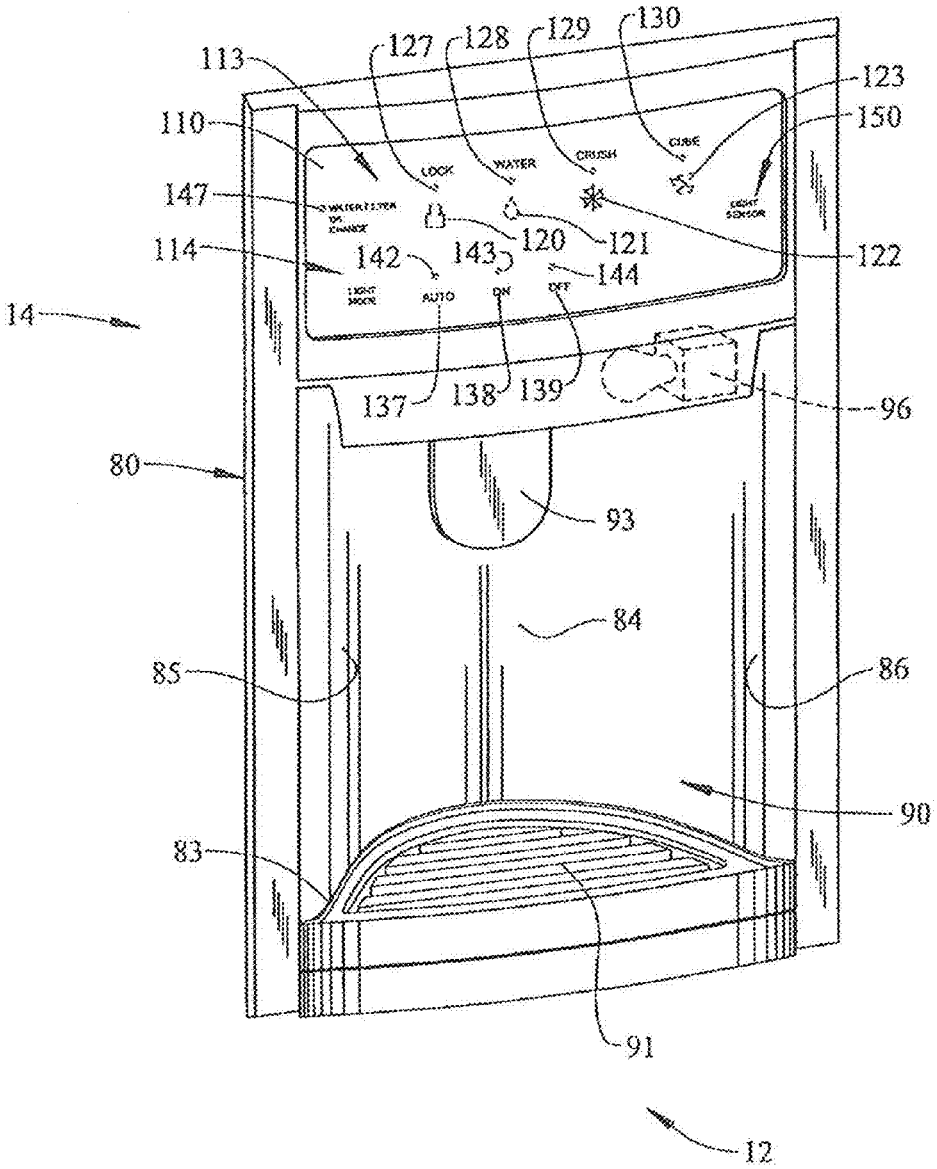
FIG. 2 is an enlarged perspective view of a portion of the door mounted dispenser of FIG. 1.

The present invention is directed to the particular operation of dispenser 14. As best shown in FIG. 2, dispenser 14 includes a housing 80 having bottom, rear and opposing side walls 83-86 that collectively define a cavity 90. As shown, bottom wall 83 is provided with a removable grate 91 that entraps water or melted ice and provides a stable surface for a container or glass. In addition, dispenser 14 is shown to include a release mechanism 93 which, when activated, delivers water and/or ice depending upon a consumer's particular need in a manner that will be described more fully below. Dispenser 14 is also provided with a cavity light 96 which is activated to illuminate cavity 90.

As further shown in FIG. 2, dispenser 14 includes a control panel 110 having a plurality of control elements. In accordance with one embodiment, the control elements are constituted by first and second sets of dispenser control buttons 113 and 114. As shown, the first set of control buttons 113 includes a lock button 120, a water button 121, a crushed ice button 122 and a cubed ice button 123. Each of buttons 120-123 is preferably provided with a corresponding indicator light 127-130 which, when illuminated, indicates which one of buttons 120-123 has been selected. In accordance with the most preferred form of the invention, the second set of control buttons 114 is employed to set an operational mode for cavity light 96. More specifically, second set of control buttons 114 includes an AUTO button 137, an ON button 138 and an OFF button 139 which establishes three distinct operating modes for cavity light 96. In a manner similar to that described above, control buttons 137-139 have associated therewith corresponding indicator lights 142-144 which, when illuminated, designate the current or active mode for cavity light 96. For the sake of completeness, control panel 110 is also shown to include a water filter indicator 147 that signals when a water filter (not shown), associated with dispenser 14, requires changing. Finally, control panel 110 is provided with a sensor 150 which, in a manner that will be discussed below, is operatively associated with cavity light 96.

As set forth above, cavity light 96 is operable in three distinct modes which may be selected through control buttons 137-139. More specifically, cavity light 96 can be operated in an AUTO mode through activation of button 137, an ON mode through activation of button 138 and an OFF mode through activation of button 139. In the ON mode, cavity light 96 is continuously illuminated as long as power is supplied to refrigerator 2, regardless of whether release mechanism 93 is activated. Conversely, in the OFF mode, cavity light 96 remains inactive until release mechanism 93 is activated to dispense water and/or ice. More specifically, manipulation of release mechanism 93 activates cavity light 96 to illuminate cavity 90. In the most preferred form of the invention, once a consumer has completed the water and/or ice dispensing operation, i.e., following de-activation of the dispensing operation, the intensity of cavity light 96 will gradually decrease or decay as if on a dimmer, until cavity light 96 is inactive.

In the AUTO mode, cavity light 96 is activated when ambient light, at or about refrigerator 2, reaches a predetermined level. More specifically, as ambient light about refrigerator 2 begins to diminish, cavity light 96 is activated to serve as, for example, a night light. In accordance with one aspect of the invention, cavity light 96 is activated at a first illumination level once the ambient light has reached the predetermined level. However, when release mechanism 93 is activated, the intensity of cavity light 96 increases to full power to provide illumination to cavity 90. In a manner similar to that described above with respect to the OFF mode of operation, once the consumer has finished dispensing water and/or ice, the intensity of cavity light 96 will gradually decrease or decay, as if on a dimmer, until reaching the first intensity level.

In accordance with the most preferred form of the invention, the predetermined level of ambient light can be selected by a consumer. That is, if a consumer wishes to have cavity light 96 activated at either a lighter or darker ambient light level, the consumer simply selects the desired light level through interface 40. In further accordance with the most preferred form of the invention, a user can select from a low light level through a high light level by choosing a value between 1 and, for example, 7. For example, if a consumer wishes cavity light 96 to be illuminated at a higher degree of ambient light, a 1 is entered into a light level selection portion of interface 40 or, alternatively, if a consumer wishes ambient light to be at a lower level, a 7 can be entered into interface 40. With this arrangement, the light control of the present invention allows a consumer to adapt an operation of a dispenser cavity light 96 to accommodate various installations. That is, depending on whether the refrigerator is located in lighter or darker areas of a kitchen, operation of the cavity light 96 can be tailored to the surrounding light levels.

Although described with reference to a preferred embodiment of the invention, it should be readily understood that various changes and/or modifications can be made to the invention without departing from the spirit thereof. For instance, the particular form and arrangement of control panel 110 and, for that matter, dispenser 14, can vary without departing from the scope of the present invention. In general, the invention is only intended to be limited by the scope of the following claims.

I claim:

1. A method of operating an ice and/or water dispenser cavity light provided in a refrigerator comprising:

selecting an ambient light level at which the dispenser cavity light will be illuminated; and operating the cavity light in: a first mode wherein the cavity light is continuously illuminated, a second mode wherein the cavity light is illuminated only after activation of a dispenser mechanism, and a third mode wherein the cavity light is illuminated based on the selected ambient light level.

2. The method of claim 1, further comprising: activating the cavity light at a first level based upon the level of ambient light and at a second level upon activation of the dispensing mechanism when in the third mode.

3. The method of claim 1, further comprising: manually selecting between the first, second and third modes at the dispenser mechanism.

4. The method of claim 3, further comprising: illuminating at least one indicator light associated with a respective one of the first, second and third modes.

5. The method of claim 1, further comprising: gradually decreasing a level of the light following de-activation of the dispensing mechanism.

6. In a refrigerator including a cabinet, a door mounted to the cabinet for exposing an interior compartment of the refrigerator, a control panel having a plurality of control elements for inputting operating parameters for the refrigerator, a dispenser formed in the door and including a housing having bottom, rear and opposing side walls that collectively define a cavity, a mechanism for dispensing at least one of ice and water, and a light for selectively illuminating the cavity, a method of controlling the cavity light comprising:

sensing a level of ambient light; and controlling the cavity light:

a) in a first mode wherein the cavity light is continuously illuminated;

b) in a second mode wherein the cavity light is illuminated only through activation of the dispensing mechanism; and c) in a third mode wherein the cavity light is illuminated based upon whether the level of ambient light is less than a predetermined level, wherein said predetermined level is adjustable.

7. The method of claim 6, further comprising: adjusting the predetermined level through the control panel.

8. The method of claim 6, further comprising: activating the cavity light at a first level based upon the level of ambient light and at a second level upon activation of the dispensing mechanism when in the third mode.

9. The method of claim 6, further comprising: selecting between the first, second and third modes through at least one control element provided at the dispenser.

10. The method of claim 6, further comprising: illuminating at least one of a plurality of indicator lights provided on the dispenser based on operation in the first, second or third mode respectively.

11. The method of claim 6, further comprising: illuminating the cavity light at gradually decreasing levels following de-activation of the dispensing mechanism.

12. In a refrigerator including a cabinet, a door mounted to the cabinet for exposing an interior compartment of the refrigerator, a control panel having a plurality of control elements for inputting operating parameters for the refrigerator, a dispenser formed in the door and including a housing having bottom, rear and opposing side walls that collectively define a cavity, a mechanism for dispensing at least one of ice and water, and a light for selectively illuminating the cavity, a method of controlling the cavity light comprising:

sensing a level of ambient light; and controlling the cavity light:

a) in a first mode wherein the light is continuously illuminated;

b) in a second mode wherein the cavity light is illuminated only through activation of the dispensing mechanism; and c) in a third mode wherein the cavity light is illuminated based upon whether the level of ambient light is less than a predetermined level wherein, when in the third mode, the cavity light is activated at a first level based upon the level of ambient light and at a second level upon activation of the dispensing mechanism.

13. The method of claim 12, further comprising: adjusting the predetermined level through the control panel.

14. The method of claim 12, further comprising: activating the cavity light at a first level based upon the level of ambient light and at a second level upon activation of the dispensing mechanism when in the third mode.

15. The method of claim 12, further comprising: selecting between the first, second and third modes through at least one control element provided at the dispenser.

16. The method of claim 12, further comprising: illuminating at least one of a plurality of indicator lights provided on the dispenser based on operation in the first, second or third mode respectively.

17. The method of claim 12, further comprising: illuminating the cavity light at gradually decreasing levels following de-activation of the dispensing mechanism.

* * * * *